United States Patent [19]

Miller et al.

[11] Patent Number: 4,789,762

[45] Date of Patent: Dec. 6, 1988

[54] MINIATURE MULTIPLANAR ACCELERATION SWITCH

[75] Inventors: James R. Miller, Center Moriches; Leonard P. Tetrault, Northport, both of N.Y.

[73] Assignee: Aerodyne Controls Corporation, Ronkonkoma, N.Y.

[21] Appl. No.: 159,531

[22] Filed: Feb. 9, 1988

[51] Int. Cl.[4] ..... H01H 35/14

[52] U.S. Cl. ..... 200/61.45 R; 200/61.51

[58] Field of Search ..... 200/61.45 R, 61.48, 200/61.49, 61.51, 61.52, 61.53

[56] References Cited

U.S. PATENT DOCUMENTS

| | | | |
|---|---|---|---|
| 3,300,603 | 1/1967 | Wakely | 200/61.45 R |
| 3,649,787 | 3/1972 | Kasabian | 200/61.45 R |
| 3,657,500 | 4/1972 | Gawlick et al. | 200/61.45 R |
| 3,899,649 | 8/1975 | Jenkins | 200/61.45 R X |
| 4,746,774 | 5/1988 | Tetrault | 200/61.45 R |

*Primary Examiner*—J. R. Scott

*Attorney, Agent, or Firm*—Edward H. Loveman

[57] ABSTRACT

This miniature multiplanar acceleration switch has a generally cylindrical electrically conductive mass held by coil spring bias in abutment with one end of a cylindrical chamber in a metal shell. The diameter of the mass is smaller than that of the chamber and is tapered so that the mass can tilt in response to a laterally directed force of acceleration to dispose its axis at an angle to the axis of the chamber. The mass has an inner end formed with a bore into which extends the end of a circuit lead carried by a glass insulator bonded to a header closing the other end of the chamber. When the mass tilts, the lead is contacted by the mass to close an electric circuit.

9 Claims, 2 Drawing Sheets

MINIATURE MULTIPLANAR ACCELERATION SWITCH

BACKGROUND OF THE INVENTION

1. Field of the Invention

This invention relates to the art of electrical acceleration switches, and more particularly concerns a miniature acceleration switch of the type having a mass movable against spring bias in a housing to contact a switch terminal, where the mass is responsive to forces of acceleration applied in planes at angles to the longitudinal, central axis of the mass to move or tilt the mass laterally or rotationally.

2. Description of the Prior Art

A typical prior miniature acceleration switch of the type having a movable mass, includes a cylindrical shell closed by a header at one end. In the shell is a cylindrical mass movable axially in response to forces of acceleration applied axially of the shell and mass to move the mass axially. The electrically conductive mass closes an electric circuit between the electrically conductive shell and a circuit terminal lead carried by, but insulated from the header. In a copending U.S. patent application, assigned to the same assignee as the present application, entitled "Improved Miniature Acceleration Switch", Ser. No. 103,131, filed Sept. 28, 1987, now U.S. Pat. No. 4,746,774 which issued on May 24, 1988, there is described an improved version of the prior type of acceleration switch referred to above. The improved acceleration switch disclosed in the abovementioned copending patent application is also responsive to only those forces of acceleration applied parallel to the aligned and registering central, longitudinal axes of the shell and movable mass.

SUMMARY OF THE INVENTION

The present invention concerns a further improved miniature acceleration switch which is responsive to forces of acceleration applied in any direction in planes at angles to the longitudinal axis of the movable mass. Closure of the electrical contacts of the switch occurs in instances when a predetermined acceleration is applied in any direction in a plane oblique to the longitudinal axis of the mass. According to the invention, the cylindrical shell in which the mass moves is provided with a closed end wall having a concavely curved corner against which bears a sharp peripheral edge of a radial flange at one end of the movable mass. The mass is spring biased against the closed end wall of the shell so that it will tilt or rotate laterally to its axis. The mass may be formed with an axial cylindrical bore open at the other end of the cylindrical mass. Into this opening and radially spaced therefrom is a rigid circuit lead or pin carried by an insulator secured in the other end wall or header of the shell. When the mass tilts, the electrically conductive mass contacts the electrically conductive lead. If desired, the bore may be closed at the other end of the cylindrical mass, so that if the mass is subjected to a predetermined force applied parallel to its longitudinal axis, the mass will move axially to contact the closed end of the bore which will be effective to contact the circuit pin or lead extending into the apertured mass. The present switch embodies other improvements over the prior acceleration switches which result in longer shelf storage life, greater resistance to corrosion, greater sensitivity to applied forces of acceleration, more reliable performance.

These and other objects and many of the attendant advantages of this invention will be readily appreciated as the same becomes better understood by reference to the following detailed description when considered in connection with the accompanying drawings in which:

DESCRIPTION OF THE PREFERRED EMBODIMENT

Figure 1:
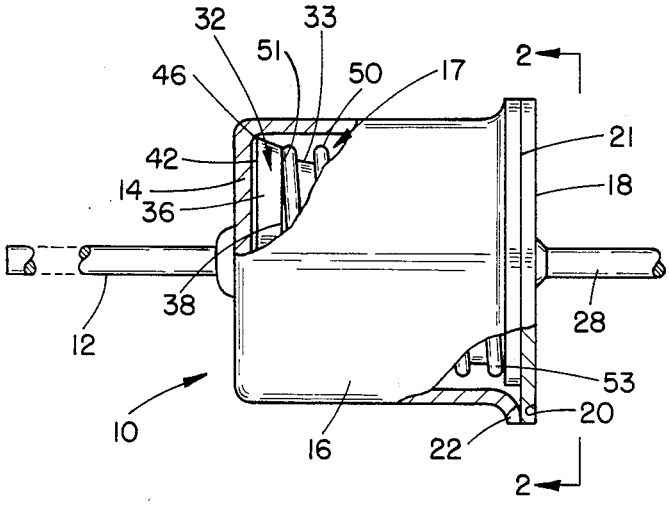
FIG. 1 is a side view of a greatly magnified miniature acceleration switch embodying the invention, parts being broken away to show internal construction.
Figure 2:
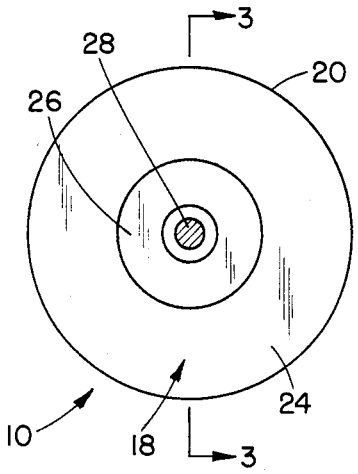
FIG. 2 is an end elevational view taken along line 2—2 of FIG. 1.

Referring now to the drawings wherein like reference characters designate like or corresponding parts throughout, there is illustrated in FIGS. 1–8, a miniature acceleration switch generally designated as reference numeral 10, embodying the invention. The new switch 10 has a circuit lead 12 connected to a closed circular end wall 14 of a cylindrical shell or housing 16, in which is a cylindrical chamber 17. A disk-like header 18 has an annular peripheral edge 20 secured by a continuous weld 21 to an annular flange 22 at the other end of the shell 16. The header 18 has an outer metal ring or eyelet 24 and a circular glass insulator disk 26 set in a central opening 27 in the ring 24. Another circuit lead 28 extends through the center of the glass insulator 26 and is fused and bonded thereto. An end portion 29 of the lead 28 projects axially through a hole 30 adjacent an inner end 31 of an electrically conductive frustoconical body 33 of metal mass 32. The hole 30 is disposed axially of the mass 32 at the end of a cylindrical bore 34 formed axially in the mass 32. The diameter of the hole 30 is larger than the lead end portion 29 which is centered in the hole 30. The radial spacing between the lead end portion 29 and the periphery or rim of the hole 30 is critical in determining the sensitivity of the switch 10 as further explained below. The size of the chamber defined by bore 34 is also critical in locating the center of gravity of the mass 32 and in determining the sensitivity of the switch 10.

The mass 32 has a frustoconical body 33 terminating at its rear end with an annular flange 36 having a forward facing flat annular shoulder 38. The frustoconical flange 36 is of larger diameter than the body 33 extending from the shoulder 38 to a flat end wall 42. A sharp peripheral corner 44 (best shown in FIG. 7) is defined between a frustoconical flange wall 40 and a flat end wall 42. The corner 44 abuts a concave corner 46 formed in the shell 16 at the junction of the end wall 14 and the cylindrical wall of the shell 16. The contact between the mass 32 and the shell 16 is thus limited to the circular line defined by the sharp corner 44 nesting in the concave corner 46 which has a circular radius of curvature of about 0.010 inches in a practical embodiment of the miniature switch 10. A cylindrical coil spring 50 is disposed axially in the shell 16. One end 51 of the spring 50 bears on the shoulder 38. The other end 53 of the spring 50 bears on an annular shoulder 52 which is the inner wall of a circular recess 54 formed in the inner side of the ring 24. By the arrangement described above, the bias in the spring 50 holds the mass 32 in abutment with the end wall 14 with the corner edge 44 abutted to the concave corner 46, and the axis of the mass 32 and the body 33 aligned and registered with the axis of the shell 16 and the chamber 17.

In operation of the switch 10, when the switch is accelerated in any direction at an angle to the central axis of the mass 32, the mass 32 will twist or rotate about the concave corner 46. If the acceleration force is sufficient in magnitude, the rim of the hole 30 will contact the lead end 29 to close an external circuit (not shown) connected between the leads 12 and 28. The tapering shape of the frustoconical body of the mass 32 prevents contact between the intermediate turns of the spring 50 and the mass 32. Such contact would be most undesirable since it would adversely affect the sensitivity of response of the switch 10 and could prevent operations thereof. If there is a component of force of acceleration directed axially of the mass 32, the mass may move axially but this will be ineffective to cause contact between the mass 32 and the lead end 29. It is only those components of force of acceleration directed at an angle to the axis of the mass which will cause it to twist or rotate laterally to effect contact between the rim of the hole 30 and the lead end 29. Since operation of the switch depends on lateral movement of the rim of hole 30 to contact the lead end 29, the radial distance between the axially centered end portion 29 and the rim of hole 30 is critical. Thus for example, enlarging the hole will vary the sensitivity of the switch to require more lateral displacement of the mass 32 to effect closure of the electrical circuit.

Figure 3:
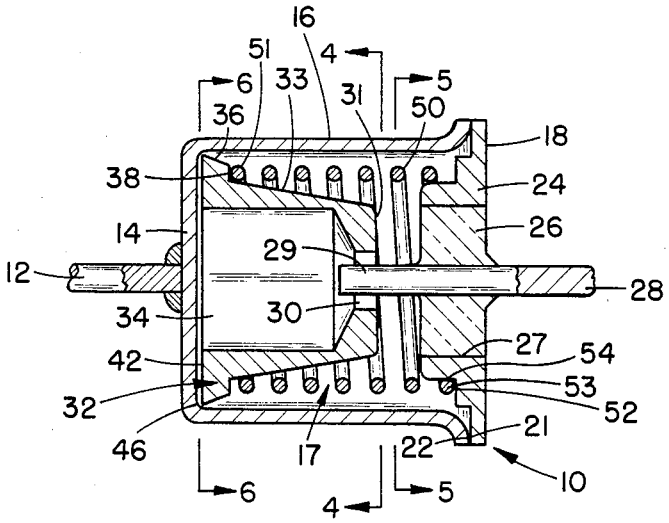
FIG. 3 is a longitudinal, central axial sectional view taken along line 3—3 of FIG. 2.
Figure 4:
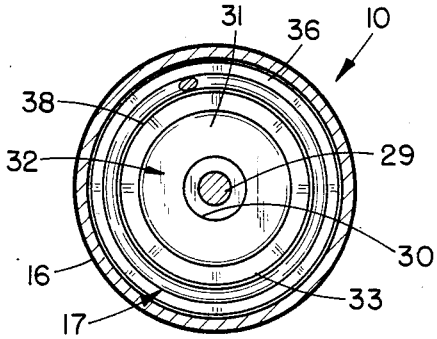
FIGS. 4, 5, and 6, are cross sectional views taken along lines 4—4, 5—5, and 6—6 respectively of FIG. 3.
Figure 5:
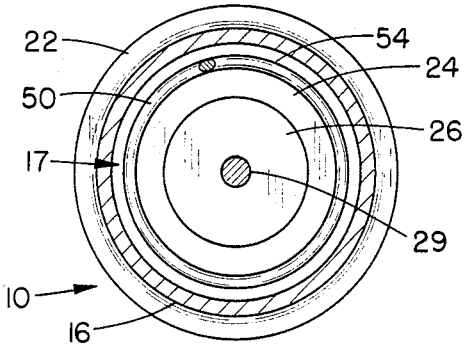
Figure 6:
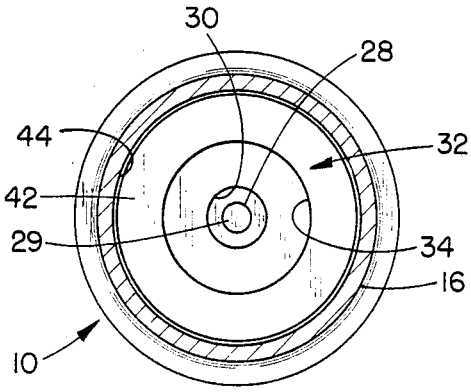
Figure 8:
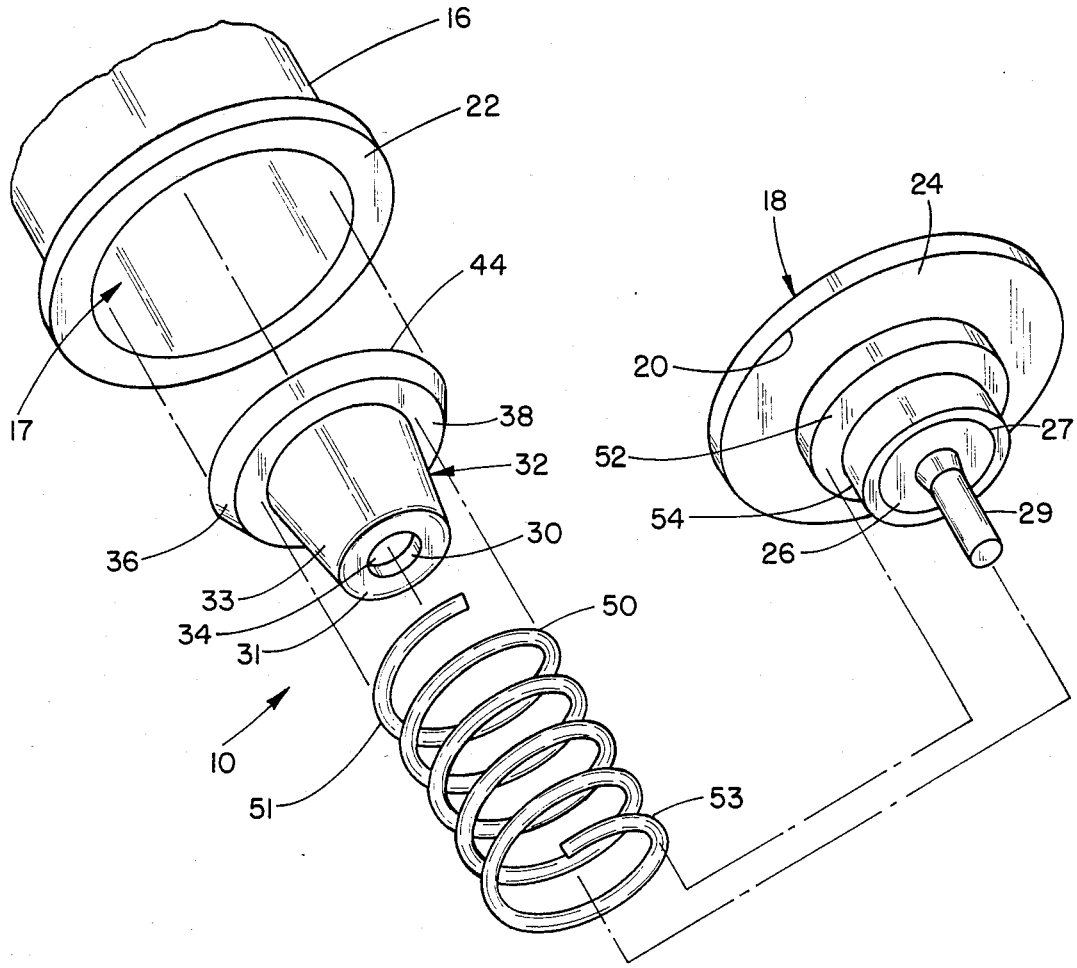
FIG. 8 is an enlarged perspective view of parts of the acceleration shown in FIGS. 1–7.
Figure 7:
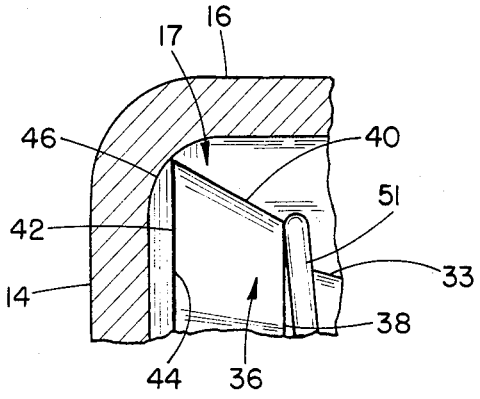
FIG. 7 is an enlarged corner portion of the switch as shown in FIG. 1.
Figure 9:
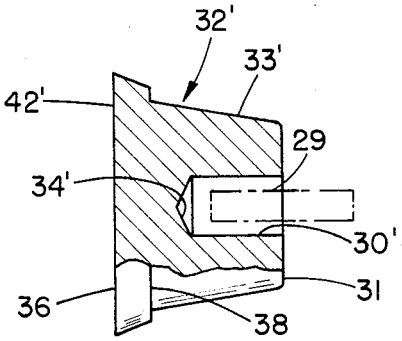
FIG. 9 is a longitudinal, central axial view similar to a portion of FIG. 3 showing another form of movable mass.

The location of the center of gravity of the mass 32 is dependent upon the size of the chamber in the mass 32 defined by the bore 34. If the mass 32 is of minimum weight and cup shaped, as best shown in FIG. 3, the center of gravity will be located forward and close to the inner end wall 31. Thus the mass 32 will tilt most readily in response to minimum angular force of acceleration applied to the mass 32. If it is desired to make the switch less sensitive to lateral or angular forces, the construction of a mass 32' shown in FIG. 9 can be used. Here a hole 30' in a body 33' is extended to define a blind bore 34'. Now the center of gravity will be closer to an end wall 42' and will require a larger angular or lateral force to turn or tilt the mass 32' than is required with the shell-like mass 32. From the foregoing, it will be apparent that varying the size of the internal bore 34 or the blind bore 34' in the mass 32 or 32' respectively, and/or the diameter of the hole 30 or 30' through which the lead end 29 extends, determines the sensitivity of response of the switch 10 to lateral or angular forces of acceleration. Moreover, if desired, the switch 10 with the mass 32' may be used to respond to axial forces, as well as forces of acceleration applied in planes at angles to the longitudinal axis of the moveable mass, by adjusting the bias or load on the spring 50, so that the tip of the lead end portion 29 will contact the closed end of the blind hole 34', at a predetermined axial acceleration.

The present invention has a number of further features which insure greater reliability and longer shelf life than prior miniature acceleration switches. As one important feature, the chamber 17, is filled with a dry inert gas, such as nitrogen, helium, or a mixture thereof, at a low pressure so as not to interfere with movement of the mass 32 and operation of the switch 10, but the gas will be sufficient to prevent corrosion of the internal parts of the switch assembly. However if desired, the chamber 17 may be filled with an oil instead of an inert gas, to slow or damp the response of the mass 32 to an acceleration input. The oil will also prevent corrosion of the internal parts of the switch assembly 10.

After the mass 32 or 32' and the spring 50 are installed, the air in the chamber 17 is evacuated and replace with a dry inert gas. Then the header 18 is applied and the flange 22 is secured to header rim 20 by the continuous weld 21 to seal the chamber 17 hermetically and permanently. The glass insulator 26 bonded to ring 24 is stable dimensionally and is chemically inert so that it will not shrink away from the center of the ring 24 to leak air, as has happened with prior acceleration switches which use a plastic insulator instead of a glass insulator. The ends of the spring 50 cannot shift laterally to jam the mass 32 and prevent the mass from moving or turning laterally. Also the wide spacing between the intermediate coil turns and the tapered body 33 prevent the further improvement the mass 32, the spring 50 and the header 18 are plated with corrosion resistant metal.

In a typical miniature acceleration switch 10, the mass 32 may have a maximum diameter at face 42 of about 0.163 inches. The inside diameter of the chamber 17 in the shell 16 may be about 0.170 to allow the mass 32 to turn or tilt freely laterally. The shell 16 may be about 0.190 inches in length and have an outer diameter of 0.0190 inches. The normal spacing or gap between the rim of the hole 30 and the adjacent lead tip 29 may be about 0.015 inches. The gap between the inside of the spring 50 and the periphery of the end 31 of the body 33 may be about 0.020 inches. The larger spacing between the spring 50 and body 33 insures that the mass 32 contacts the lead end 29 before the body 33 contacts the spring 50 when the mass 32 turns laterally upon application of an angular force of acceleration. The dimensions stated are only an example and may be larger or smaller depending on the specified parameters of the switch 10.

By the special features described the useful life of the switch 10 during which it will retain its specified operating parameters may be extended to fifteen years or more. The miniature acceleration switch 10 will operate at all times in response to a force of acceleration within 15% of that specified or prescribed. All parts of the switch 10 may be made by precision, mass production methods to minimize cost of manufacture.

Although the forward end 53 of the spring 50 has been described and shown as fitting into an outer annular recess 54 formed in the ring 24 of the header 18, it is possible to form a circumferential groove in the ring 24 radially spaced from the inside wall of the shell 16 to receive the end 53 of spring 50 in a snug frictional fit to resist lateral displacement of the spring.

It should be understood that the foregoing relates to only a preferred embodiment of the invention, which has been by way of example only, and that it is intended to cover all changes and modifications of the examples of the invention herein chosen for the purpose of the disclosure, which do not constitute departures from the spirit and scope of the invention.

What is claimed is:

1. A miniature multiplanar acceleration switch, comprising:

a hollow cylindrical electrically conductive metal shell closed at one end and open at its other end to define a cylindrical chamber therein;

an electrically conductive metal mass movable in said chamber, said mass having a generally cylindrical body axially aligned with that of said chamber, said body having a radially extending annular flange at one end thereof disposed at said closed end of said shell and arranged to permit said body to tilt to dispose its axis at an angle to said axis of said shell, said flange defining a continuous annular shoulder facing the other end of said shell, and a bore in the other end of said body defining a circular hole whose center registers with said axis of said body and whose rim is equally spaced radially at all points from said axis of said body;

a header closing said chamber at the other end of said shell, said header having an electrically conductive metal ring secured to said shell, and a central insulator bonded to and inside of said ring;

said body having a frustoconical wall extending from said shoulder and tapering inwardly radially toward said header;

a circuit lead extending axially through said insulator and bonded thereto, said lead having a pin-like tip end projecting axially into said bore centrally thereof; and a cylindrical, electrically conductive coil spring in said chamber extending axially thereof and surrounding a major portion of said mass, opposite end turns of said spring being disposed respectively at said shoulder of said annular flange and at said ring of said header, said spring biasing said body against said closed end of said shell, all intermediate turns of said spring being spaced radially from said body at all positions of tilt of said mass in said chamber;

whereby said mass tilts angularly to said axis of said chamber when a force of acceleration is directed laterally to said mass in a direction other than one parallel to said axis of of said body, to cause direct contact between said tip of said circuit lead and the rim of said hole in said body before any of said intermediate turns of said spring can contact said body.

2. A miniature multiplanar acceleration switch as defined in claim 1, wherein said shell is formed with a concave circumferential corner at said closed end thereof, and wherein said annular flange of said body fits slidingly in said concave corner to permit said mass to tilt angularly to said axis of said chamber when a force of acceleration of sufficient magnitude is directed laterally to said mass.

3. A miniature multiplanar acceleration switch as defined in claim 1, wherein said bore in said body extends through said body from end to end thereof and is enlarged to minimize the weight of said mass and to locate the center of gravity of said mass as far forward toward said hole as possible to minimize the magnitude of lateral force required to cause said mass to tilt and contact said circuit lead at said hole.

4. A miniature multiplanar acceleration switch as defined in claim 1, wherein said bore in said body extends inwardly of said body from said other end but has a bore end that terminates axially short of said one end of said body to locate the center of gravity of said mass rearwardly from said other end of said body to enlarge the magnitude of lateral force required to cause the mass to tilt and contact said circuit lead at said hole, and to permit the end of said lead to contact the end of said bore in response to a predetermined axial force.

5. A miniature multiplanar acceleration switch as defined in claim 1, wherein said chamber is filled with inert gas to prevent corrosion of metal parts in said chamber, said gas having sufficiently low pressure to prevent interference with movement of said mass in said chamber.

6. A miniature multiplanar acceleration switch as defined in claim 1, wherein said ring in said header is formed with an annular recess for receiving one end of said spring, to avoid twisting of turns of said spring and to prevent jamming of said mass against lateral tilting movement.

7. A miniature multiplanar acceleration switch as defined in claim 1, wherein said insulator is made of dimensionally stable dielectric material such as glass, said insulator being fused to said ring in a permanent, hermetically sealed bond.

8. A miniature multiplanar acceleration switch as defined in claim 1, comprising another circuit lead in electrical contact with said shell so that both of said leads are connected in direct electric circuit via said shell and said mass when said mass contacts said tip end of said first named lead.

9. A miniature multiplanar acceleration switch as defined in claim 1, wherein said shell is formed with a concave circumferential corner at said closed end thereof, and wherein said annular flange of said body is formed with a sharp, continuous, peripheral edge which fits slidingly in said concave corner to facilitate tilting of said mass angularly to said axis of said chamber when a force of acceleration of sufficient magnitude is directed laterally to said mass at an angle to its axis.

* * * * *